US007705544B1

(12) United States Patent
Kipervaser et al.

(10) Patent No.: US 7,705,544 B1
(45) Date of Patent: Apr. 27, 2010

(54) LAMP CIRCUIT WITH CONTROLLED IGNITION PULSE VOLTAGES OVER A WIDE RANGE OF BALLAST-TO-LAMP DISTANCES

(75) Inventors: Yakov Kipervaser, Buffalo Grove, IL (US); Michael Litvinovich, Naperville, IL (US)

(73) Assignee: Universal Lighting Technologies, Inc., Madison, AL (US)

( * ) Notice: Subject to any disclaimer, the term of this patent is extended or adjusted under 35 U.S.C. 154(b) by 334 days.

(21) Appl. No.: 11/941,142

(22) Filed: Nov. 16, 2007

(51) Int. Cl.
*H05B 37/02* (2006.01)

(52) U.S. Cl. ..... 315/209 CD; 315/289

(58) Field of Classification Search ..... 315/227 R, 315/244, 246, 283, 289, 290, 209 CD, 291, 315/310, 311
See application file for complete search history.

(56) References Cited

U.S. PATENT DOCUMENTS

| | | | | |
|---|---|---|---|---|
| 3,917,976 | A | 11/1975 | Nuckolls | |
| 4,209,730 | A | 6/1980 | Pasik | |
| 4,275,337 | A | 6/1981 | Knoble et al. | |
| 4,480,214 | A | 10/1984 | Sodini | |
| 4,695,771 | A | 9/1987 | Hallay | |
| 4,958,107 | A * | 9/1990 | Mattas et al. | 315/289 |
| 5,013,977 | A | 5/1991 | Droho | |
| 5,047,694 | A * | 9/1991 | Nuckolls et al. | 315/290 |
| 5,166,581 | A | 11/1992 | Chermin et al. | |
| 5,321,338 | A * | 6/1994 | Nuckolls et al. | 315/290 |
| 5,594,308 | A * | 1/1997 | Nuckolls et al. | 315/290 |
| 5,825,139 | A * | 10/1998 | Nuckolls et al. | 315/307 |
| 6,091,208 | A * | 7/2000 | Flory, IV | 315/290 |
| 6,144,171 | A | 11/2000 | Clements et al. | |
| 6,323,603 | B1 | 11/2001 | Persson | |
| 6,362,576 | B1 | 3/2002 | Huber et al. | |
| 6,373,199 | B1 | 4/2002 | Erhardt et al. | |
| 6,396,220 | B1 | 5/2002 | Delia et al. | |
| 6,522,088 | B2 | 2/2003 | Delia | |
| 6,597,128 | B2 | 7/2003 | Flory, IV et al. | |
| 2006/0097652 | A1 | 5/2006 | Van Casteren et al. | |

FOREIGN PATENT DOCUMENTS

| | | |
|---|---|---|
| DE | 3704441 | 10/1987 |
| JP | 2005251722 | 9/2005 |

* cited by examiner

*Primary Examiner*—Thuy Vinh Tran
(74) *Attorney, Agent, or Firm*—Waddey & Patterson; Mark J. Patterson; Gary L. Montle

(57) ABSTRACT

A lamp ignition circuit provides a high voltage electrical pulse to ignite a gas discharge lamp. A non-linear filter element within a charge circuit regulates the voltage of the ignition pulse such that the ignition pulse remains within a prescribed voltage range over a wide variety of conduit lengths between the lamp and the lamp ignition circuit. This allows for the ballast and lamp ignition circuit to be mounted either close to the lamp or far from the lamp without modifying the ignition circuitry.

16 Claims, 2 Drawing Sheets

LAMP CIRCUIT WITH CONTROLLED IGNITION PULSE VOLTAGES OVER A WIDE RANGE OF BALLAST-TO-LAMP DISTANCES

CROSS-REFERENCES TO RELATED APPLICATIONS

None.

BACKGROUND OF THE INVENTION

This invention relates generally to ballasts used to power gas discharge lamps. More particularly, this invention pertains to circuits used in conjunction with a magnetic ballast to ignite a gas discharge lamp.

Gas discharge lamps require a high voltage pulse of electricity for ignition. The design of the lamp determines the voltage requirements for the ignition pulse, and there is typically a minimum and maximum voltage requirement for the ignition pulse. After a gas discharge lamp is ignited, the lamp presents a negative resistance. Therefore, a ballast is used to control and limit the amount of current going to the lamp after ignition. In many commercial lighting environments, the ballast and ignition circuit (sometimes referred to as a "starter" circuit) are connected to the lamp using electrical wires placed in a conduit. This arrangement creates a parasitic capacitance which increases with increased conduit length. The larger the parasitic capacitance, the greater the load affecting the amplitude of an ignition pulse from a lamp starter circuit. The conduit length actually installed in the field is variable, so the amount of parasitic capacitance associated with the conduit is variable. A starter circuit which can simply and reliably provide ignition pulses having a voltage within the prescribed range over a wide variety of conduit lengths is desirable.

Many circuits have been developed to deliver ignition pulses to lamps over varying starter-circuit-to-lamp conduit lengths. For example, U.S. Pat. No. 6,522,088 describes a starter circuit having a voltage clamping device connected between the two leads to the lamp. The ballast circuitry is capable of generating an ignition pulse having a voltage in excess of the prescribed range for the lamp. Due to the higher voltage of the ignition pulse, a longer conduit length between the lamp and the ballast circuitry is possible. If the longer length is used, the parasitic capacitance reduces the voltage of the ignition pulse to within the prescribed range. The voltage clamping device has an impedance which varies with voltage such that if the voltage exceeds the clamping voltage, the impedance drops and thereby lowers the voltage of the ignition pulse delivered to the lamp. The voltage clamping device is typically comprised of two varistors connected in series wherein the combined clamping voltage of the two varistors is near the maximum voltage acceptable for the lamp. Unfortunately, using a clamping device in the starting circuit adds cost which is disadvantageous in the highly competitive lighting industry. Also, the clamping device may be required to dissipate significant energy when clamping high voltage ignition pulses. This decreases reliability of the device.

Publication No. JP2005251722 describes a device having a second starting device positioned close to the lamp when the conduit length between the first starting device and the lamp is long. When the conduit between the first starting device and the lamp is short, a second starting device is not used. This provides for a wider range of acceptable conduit lengths between the first starter device and the lamp.

U.S. Pat. No. 6,396,220 describes circuitry with a first and a second reactive energy source. The first reactive energy source generates ignition pulses for longer conduit lengths, and the second reactive energy source generates ignition pulses for shorter conduit lengths. A switch is provided so that either the first or the second reactive energy source is utilized. There are several embodiments wherein different components of the ignition circuitry are switched on and off, but in all embodiments a switch is used to select between components which generate ignition pulses having different voltages.

In the highly competitive field of lighting electronics cost and reliability are important considerations. Costs can be reduced by using fewer components and/or using components designed for lower voltages. Also, as a general rule, the fewer components used, the more reliable the system. Therefore, a system using fewer components and/or components designed for lower voltage is preferred.

BRIEF SUMMARY OF THE INVENTION

The lamp ignition circuit of the present invention includes an ignition pulse source, wherein the ignition pulse source includes a ballast and a charge circuit. An ignition pulse is directed through a conduit to a lamp, and also through the charge circuit back to a power source. High impedance in the charge circuit maximizes the ignition pulse to the lamp, and reduced impedance in the charge circuit lowers the ignition pulse voltage at the lamp. There is a non-linear filter element in the charge circuit wherein the impedance of the non linear filter element varies with both frequency and voltage. The impedance of the non-linear filter element increases with higher frequencies, and the impedance decreases with higher voltages once a clamping voltage has been exceeded, regardless of the frequency. The ignition pulse voltage at the lamp is maintained within a prescribed range by a lowering of the non-linear filter element impedance when the conduit length is short, such that part of the ignition pulse is diverted through the charge circuit. When the conduit length is long, the impedance of the non-linear filter element remains high, so the ignition pulse voltage at the lamp is maximized.

DETAILED DESCRIPTION OF THE INVENTION

Figure 1:
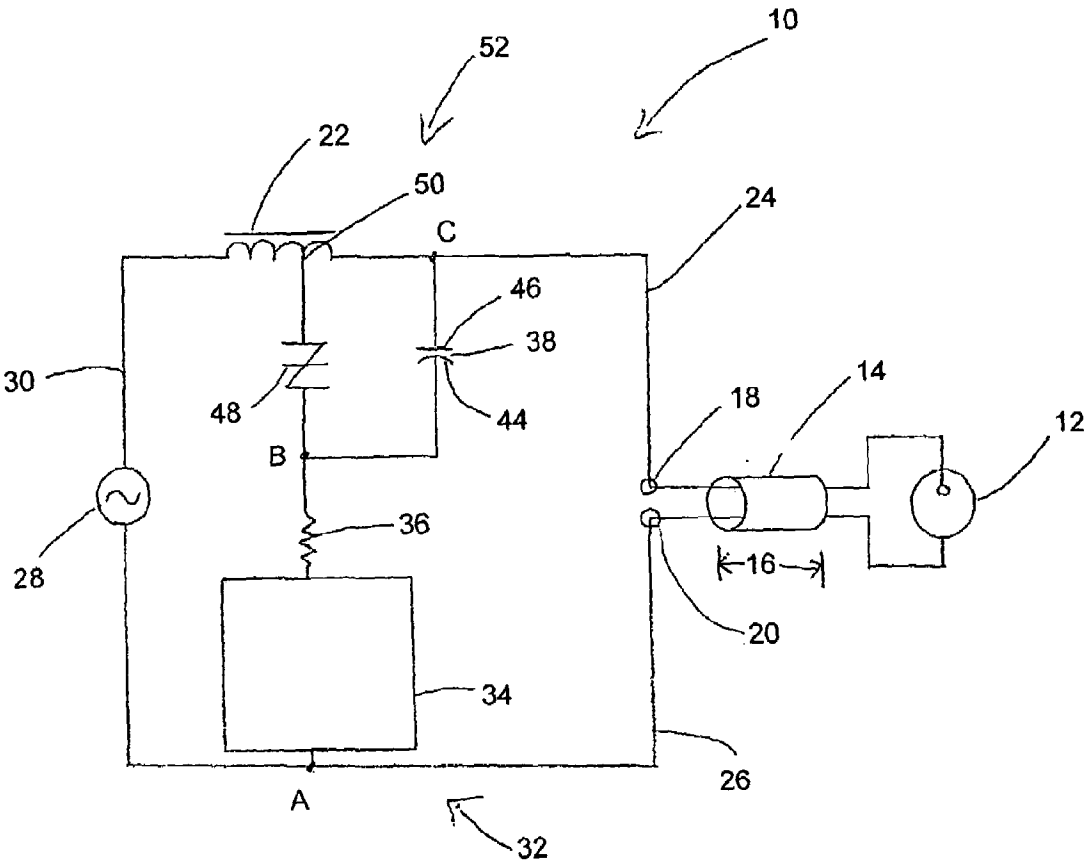
FIG. 1 is a schematic of one embodiment of a lamp circuit in accordance with the present invention, shown in combination with a ballast and gas discharge lamp.

The lamp circuit 10 shown in FIG. 1 includes a gas discharge lamp 12, such as a commonly used high intensity discharge (HID) lamp. Gas discharge lamps require a high voltage pulse for ignition. Typically this high voltage pulse, also herein referred to as an ignition pulse, has a permissible, prescribed range specific to each type of lamp. There will be a minimum voltage as necessary to ignite the lamp, and a maximum voltage rating that prevents the lamp from being damaged by the ignition pulses. As an example, a typical metal halide lamp may have a prescribed voltage range with a minimum required voltage of 3000 volts and a maximum permissible voltage of 4000 volts.

Another characteristic of the lamp 12 is that the ignition pulse necessary for igniting the lamp has a much higher peak voltage than the voltage used for operating the lamp 12 after ignition. The lamp 12 is connected to the lamp circuit 10 by a pair of wires typically enclosed in a conduit, which is also herein referred to as a line 14 or a conduit 14. In some applications, the wire 14 can be enclosed within a protective conduit, but the term conduit 14 as used herein refers to the wires delivering operating power to the lamp, regardless of whether the wires are enclosed in a protective housing or not. The conduit 14 has a conduit length 16 measured or defined between the lamp circuit 10 and the lamp itself 12. The conduit length 16 used by the end user varies, and can be long, short, or intermediate in length. As is well known in the art, the conduit 14 introduces a parasitic capacitance which increases as the conduit length 16 increases. Therefore, as the conduit length 16 increases, an ignition pulse voltage correspondingly decreases because the pulse is affected by the relatively low impedance of the parasitic capacitance.

The lamp circuit 10 includes first and second output terminals 18 and 20 respectively. The AC power source 28 is connected to terminal 20 through line 26. The ballast 22 has an input line 30 connected to AC power source 28 and an output line 24 connected to terminal 18. The ballast 22 can be a reactor ballast, a transformer ballast, an autotransformer ballast, or any other type of ballast functional to power a gas discharge lamp.

The lamp circuit 10 further includes a charge circuit 32 connected to the ballast 22 and to lines 24 and 26 at nodes C and A respectively. The charge circuit 32 includes a non-linear filtering element 34, a resistor 36, and a capacitor 38. The non-linear filtering element 34 is connected between node A and resistor 36.

Figure 2:
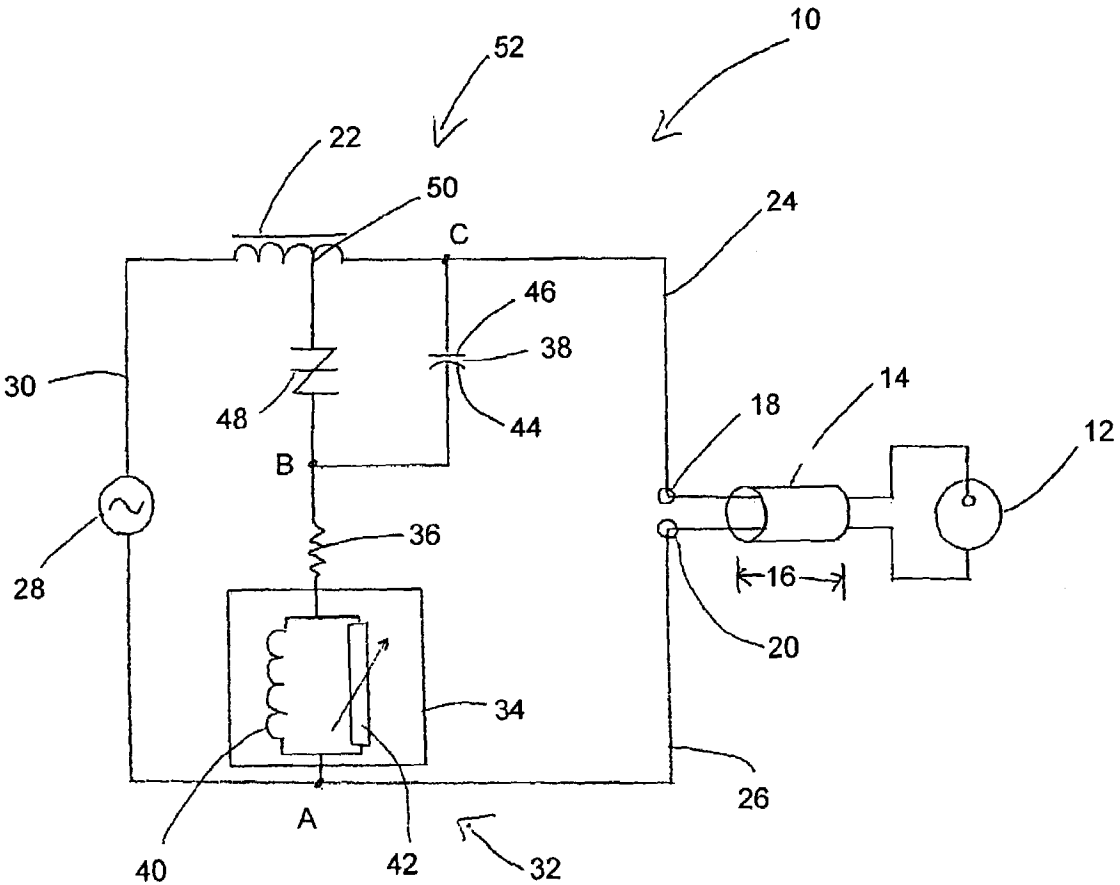
FIG. 2 is a schematic of a preferred embodiment of the lamp circuit of FIG. 1.

One embodiment of the non-linear filtering element 34 is shown in FIG. 2 and includes an inductor 40 connected in parallel with a voltage-clamping device 42.

The resistor 36 is connected in series with the non-linear filtering element 34 and, at node B, with the combination of capacitor 38 and a bilateral voltage triggered switch 48. The capacitor 38 has a first terminal 44 connected to node B and a second terminal 46 connected to node C. A first terminal of switch 48 is connected to node B, and a second terminal of switch 48 connected to an intermediate point 50 on the inductive element of ballast 22.

The impedance of the non-linear filtering element 34 varies in a non-linear fashion, and depends on both pulse frequency and peak voltage, such that the impedance of the charge circuit 32 also varies in a non-linear fashion. The impedance of the non-linear filtering element 34 is high at the ignition pulse frequencies, but also decreases with increased peak voltage. This decrease in impedance with increased voltage does not occur until after a specified threshold voltage has been exceeded. The decrease in impedance with increased voltage occurs regardless of the frequency.

A SIDAC (Silicon Diode for Alternating Current) can be used as the bilateral voltage triggered switch 48. A SIDAC, bi-directional thyristor breakover diode, or more simply a bi-directional thyristor diode, is technically specified as a bilateral voltage triggered switch. A SIDAC remains non-conducting until the applied voltage meets or exceeds its rated breakover voltage. Once entering this conductive state, the SIDAC continues to conduct, regardless of voltage, until the applied current falls below its rated holding current. At this point, the SIDAC returns to its initial non-conductive state to begin the cycle once again.

Referring to the preferred embodiment shown in FIG. 2, one manner of constructing the non-linear filtering element 34 is to connect an inductor 40 and a voltage-clamping device in parallel. In a preferred embodiment, a single varistor 42 may be used as the voltage clamping device. The impedance of inductor 40 increases when the frequency of the current increases. Therefore, the inductor 40 presents a low impedance to current from the AC power source 28 and high impedance to the short ignition pulses rich with high frequency content. The varistor 42 has a clamping voltage, and acts effectively as an open circuit where the peak voltage across the non-linear filtering element 34 is less than the clamping voltage. The impedance of the non-linear filtering element 34 at this point is thus equal to the inductor impedance, and remains very high until the clamping voltage is reached. Once the clamping voltage is reached, the impedance of the varistor 42 drops. Because the inductor 40 and the varistor 42 are connected in parallel, once the clamping voltage has been reached, the impedance of the non-linear filtering element 34 decreases, regardless of the frequency.

The lamp circuit 10 generates ignition pulses until the lamp 12 is ignited. The ignition pulses are generated by an ignition circuit 52 which is a functional combination of ballast 22, the charge circuit 32, and switch 48. It is within the knowledge of persons of ordinary skill in the art to select components for ignition circuit 52 to be capable of producing ignition pulses at a voltage exceeding the minimum voltage of the prescribed range for the lamp 12. The non-linear filtering element 34 in the charge circuit 32 prevents the ignition pulse voltage from exceeding the maximum prescribed value for the lamp 12.

The energy for the ignition pulses is provided by AC power source 28. The power source 28 is generally a 60 Hz AC commercial power source. The 60 Hz frequency is low enough for the impedance of the inductor 40 in the non-linear filtering element 34 to remain low, which allows the 60 Hz current to easily pass through the non-linear filtering element 34. The 60 Hz current charges the capacitor 38 through resistor 36.

The ignition pulse is triggered by the switch 48. The bilateral voltage-triggered switch 48 remains open until a breakover voltage is reached. Once a voltage exceeding the breakover threshold is present, the switch 48 closes and effectively becomes a short circuit. The switch 48 remains closed until the current drops below a pre-determined value. When the power source 28 begins charging the capacitor 38, the voltage at the switch 48 is below the breakover threshold and the switch 48 remains open. As the capacitor 38 is charged, the voltage at the switch 48 builds until the voltage exceeds the breakover threshold and the switch 48 closes. The capacitor 38 then discharges through the switch 48 and ballast 22. As this discharge current pulse passes through a segment or portion of the inductor in ballast 22, the voltage is stepped-up to a high voltage, short ignition pulse to be sent to the lamp 12.

The magnitude of the ignition pulse voltage at the lamp 12 depends on the effective loading on the lamp ignition circuit provided by the lamp 12, the conduit 16 and the charging circuit 32. If the conduit length 16 is long, the parasitic capacitance is high and the lamp conduit 14 presents a lower impedance load for the ignition pulse circuit 52. This can result in a lower ignition voltage at the lamp 12.

The resistor 36 and the non-linear filtering element 34 primarily determine the effective impedance of the charge circuit 32 that is presented to the ignition pulse circuit 52. The clamping voltage of the non-linear filtering element 34 is selected such that its impedance for the ignition pulse is high when the conduit length 16 is long, and so that its impedance for the ignition pulse is lower when the conduit length 16 is short. The impedance of the inductor 40 in the non-linear filtering element 34 is high for short ignition pulses rich with high frequency content. Therefore, when the conduit length 16 is long, the inductor 40 and the varistor 42 both have high impedance, which presents a lower effective load on the ignition pulse circuit 52. The impedance from the parasitic capacitance from the long conduit length 16 combined with the large impedance from the non-linear filter element 34 produces an ignition pulse voltage within the prescribed range for the lamp 12.

If the conduit length 16 is short, the parasitic capacitance of the conduit 14 is small, so the impedance of the conduit 14 is relatively high. This high impedance results in a relatively low load for the ignition pulse circuit 52. Because the clamping voltage is exceeded, the impedance of the varistor 42 in the non-linear filtering element 34 drops. The reduced impedance from the non-linear filtering element 34 produces a larger load for the ignition pulse. This serves to reduce the voltage of the ignition pulse at the lamp 12 to a voltage below the maximum. The high impedance and low parasitic capacitance from the relatively short conduit length 16 indirectly is responsible for a lower impedance in the non-linear filtering element 34 and the charge circuit 32, so the total load for the ignition pulse circuit 52 is somewhat balanced for both long and short conduit lengths 16. Therefore, the non-linear filtering element 34 prevents the ignition pulse voltage at the lamp 12 from exceeding the prescribed range by lowering the non-linear filtering element 34 impedance when the conduit length 16 is short. Therefore, the ignition pulse circuit 52 of the lamp circuit 10 provides ignition pulses to the lamp 12 within the prescribed range over a wide variety of conduit lengths 16.

Placing the non-linear filtering element 34 in the charge circuit 32 allows for a lower cost lamp circuit 10 comparing to the circuit described in U.S. Pat. No. 6,522,088. The voltage seen by the non-linear filtering element 34 during ignition pulse is lower than the ignition pulse voltage itself. Therefore, the clamping voltage of the varistor 42 in the non-linear filtering element 34 can be lower than if the varistor 42 were exposed to the whole voltage of the ignition pulse as it is in U.S. Pat. No. 6,522,088. Therefore, the clamping voltage of the varistor 42 is less than the maximum value of the prescribed voltage range of the lamp. The lower clamping voltage allows for the economical use of a single varistor 42 as the voltage clamping device. Using a single varistor 42 with a lower clamping voltage reduces the overall cost of the lamp circuit 10 comparing to that of the circuit described in U.S. Pat. No. 6,522,088 where two varistors are needed in practical application.

If the lamp 12 ignites, the lamp 12 presents a very low impedance. The voltage between nodes C and A (FIG. 2) drops then to a level lower than the break-over voltage of the bilateral voltage triggered switch 48. As a result, no more ignition pulses are generated as long as the lamp 12 remains lit. If the lamp 12 fails to ignite, the lamp 12 acts as an open circuit and the charge circuit 32 repeatedly generates ignition pulses until the lamp 12 ignites.

The present invention also includes a method of igniting a gas discharge lamp 12 over a variable conduit length 16. The method includes providing a lamp circuit 10 which is connected to a power source 28. An ignition pulse circuit 52 within the lamp circuit 10 generates a high voltage ignition pulse. Ignition pulses are repeatedly generated until the lamp ignites. A non-linear filtering element 34 clamps the voltage of the high voltage pulse below an allowed maximum voltage for the lamp 12. The non-linear filtering element 34 has an impedance that varies in a non-linear manner. The non-linear filtering element 34, and therefore the charge circuit 32, has an impedance which increases with increased frequency, and the impedance decreases when a clamping voltage is exceeded regardless of the frequency. The non-linear filtering element 34 could be comprised of, but is not limited to, an inductor 40 and a varistor 42 connected in parallel.

Thus, although there have been described particular embodiments of the present invention of a new and useful Lamp Circuit with Controlled Ignition Pulse Voltages over a Wide Range of Ballast-to-Lamp Distances, it is not intended that such references be construed as limitations upon the scope of this invention except as set forth in the following claims.

What is claimed is:

1. A lamp circuit for using an AC power source to ignite a gas discharge lamp having prescribed minimum and maximum ignition pulse voltages, the circuit comprising:

first and second lamp terminals;

an ignition pulse circuit coupled to the lamp terminals and functional to provide at least the minimum ignition pulse voltage at the lamp terminals to ignite the lamp, the ignition pulse circuit including a charge circuit;

the charge circuit comprising a non-linear filter element, the non-linear filter element providing a low effective impedance to current from the AC power source and a varying low to high effective impedance to current from the ignition pulses; and wherein the effective impedance provided by the non-linear filter element to the current from the ignition pulses decreases when the ignition pulse voltage exceeds a voltage threshold.

2. The lamp circuit of claim 1 wherein the charge circuit further comprises:

a capacitor, a resistor, and a bilateral triggered switch;

the capacitor having a first capacitor terminal connected to the resistor and to a first switch terminal of the bilateral voltage triggered switch, the bilateral voltage triggered switch having its second terminal electrically coupled to the ballast.

3. The lamp circuit of claim 2 wherein the non-linear filter element is connected between the resistor and the second lamp terminal.

4. The lamp circuit of claim 3 wherein the non-linear filter element comprises an inductor connected in parallel with a voltage clamp device.

5. The lamp circuit of claim 4 wherein voltage clamp device comprises a varistor.

6. A lighting circuit comprising:

a. a power source;

b. a ballast coupled to the power source;

c. a gas discharge lamp connected to the ballast by first and second lamp terminals through a conduit, the gas discharge lamp requiring an ignition pulse voltage within a minimum and maximum ignition pulse voltage range;

d. an ignition pulse circuit coupled to the power source and to the ballast, the ignition pulse circuit including a switch functional to trigger ignition pulses having a pulse magnitude within the ignition pulse voltage range, and wherein the pulse magnitude depends in part on a first load impedance presented to the pulse ignition circuit by the lamp and conduit; and e. a non-linear filter element coupled to the ignition circuit, to the power source, and to the lamp, the non-linear filter element presenting a second load impedance to the ignition pulse circuit that varies non-linearly in response to certain combinations of frequency and voltage to cause the ignition pulse voltage to be maintained within the ignition pulse voltage range.

7. The lighting circuit of claim 6 wherein the non-linear filter element comprises an inductor in parallel with a voltage clamp.

8. The lighting circuit of claim 7 wherein the voltage clamp comprises a single varistor.

9. The lighting circuit of claim 8 wherein the ballast has an inductive component and the ignition pulse circuit further comprises:

the switch having first and second switch terminals, the first switch terminal connected to an intermediate portion of the ballast inductive component;

a capacitor having a first capacitor terminal coupled to the ballast and to the first lamp terminal through the conduit;

the capacitor having a second capacitor terminal coupled to the second switch terminal; and a resistor coupling the second switch terminal to the non-linear filter element such that the AC power source can charge the capacitor through the resistor and the inductor in the non-linear filter element.

10. The lighting circuit of claim 9, wherein:

the varistor provides a clamping voltage that is less than the maximum ignition pulse voltage;

the second load impedance provided by the non-linear filtering element is higher for ignition pulse voltages that do not exceed the clamping voltage; and the second load impedance provided by the non-linear filtering element is lower for ignition pulse voltages that exceed the clamping voltage.

11. A ballast for providing power to a gas discharge lamp from an AC power source comprising:

a. ballast power input terminals;

b. ballast power output terminals;

c. an ignition pulse circuit operative to generate lamp ignition pulses at the ballast power output terminals;

d. a non-linear filter element coupled to the ballast input terminals, to the ignition pulse circuit and to the ballast output terminals;

e. the non-linear filter element including an inductor to present a low impedance to current from the AC power source and a high impedance to current from the ignition pulses;

f. the non-linear filter element further including a voltage clamp connected in parallel with the inductor, the voltage clamp having a clamping voltage; and g. the inductor and voltage clamp being functional to cause the non-linear filter element to lower an effective load impedance across the ballast output terminals when the ignition pulse voltage exceeds the clamping voltage and to increase the effective load impedance across the ballast output terminals when the ignition pulse voltage is below the clamping voltage.

12. The ballast of claim 11 wherein the effective load impedance across the ballast output terminals further comprises stray capacitance associated with conduit connected to the ballast output terminals.

13. The ballast of claim 12 wherein the ignition pulse circuit further comprises:

a capacitor;

a switch coupled to the ballast and to the capacitor;

a resistor coupled to the switch, to the capacitor and to the non-linear filter element; and wherein the when the switch is open the capacitor charges through the non-linear filter element and when the switch is closed the capacitor discharges through the switch and through the ballast to product the ignition pulses.

14. A method of igniting a gas discharge lamp connected to a ballast over a variable conduit length, the gas discharge lamp having a prescribed voltage range for ignition, the method comprising:

(a) providing a lamp circuit connected to a power source;

(b) generating a high voltage ignition pulse from an ignition pulse source in the lamp circuit; and (c) dividing applying the high voltage pulse between to lamp output terminals and a charge circuit, wherein the charge circuit includes a non-linear filtering element having an impedance which varies with frequency and voltage such that the impedance increases with increased frequency and the impedance decreases when a clamping voltage is exceeded regardless of the frequency.

15. The method of claim 14 further comprising repeating steps (b) and (c) until the lamp ignites.

16. The method of claim 15 wherein the non-linear filtering element comprises an inductor and a varistor connected in parallel.

* * * * *